US005332453A

United States Patent [19]

Okada et al.

[11] Patent Number: 5,332,453

[45] Date of Patent: Jul. 26, 1994

[54] HIGH TENSILE STEEL SHEET HAVING EXCELLENT STRETCH FLANGING FORMABILITY

[75] Inventors: Susumu Okada, Okayama; Kouichi Hirata; Susumu Sato, both of Chiba; Masahiko Morita; Tsuguhiko Nakagawa, both of Okayama, all of Japan

[73] Assignee: Kawasaki Steel Corporation, Japan

[21] Appl. No.: 27,182

[22] Filed: Mar. 5, 1993

[30] Foreign Application Priority Data

Mar. 6, 1992 [JP] Japan ..... 4-049825

[51] Int. Cl.[5] ..... C22C 38/14; C22C 38/12

[52] U.S. Cl. ..... 148/320; 148/319; 148/902

[58] Field of Search ..... 148/320, 319, 902

[56] References Cited

U.S. PATENT DOCUMENTS 4,504,326 3/1985 Tokunaga et al. ..... 148/320
5,017,248 5/1991 Kawano et al. ..... 148/320
5,041,166 8/1991 Matsuoka et al. ..... 148/320

FOREIGN PATENT DOCUMENTS 57137452 8/1982 Japan ..... 148/320

*Primary Examiner*—Deborah Yee
*Attorney, Agent, or Firm*—Austin R. Miller

[57] ABSTRACT

A high tensile steel sheet excelling in workability and stretch flanging formability, which is of a composite texture composed of a ferrite phase and a 2nd phase selected from the group consisting of martensite, bainite, pearlite, retained austenite and cold-transformed ferrite, wherein the volume fraction of the 2nd phase is not less than about 1.3 times higher at an outer region of the steel sheet than the volume fraction of the 2nd phase in a central region of the sheet thickness.

4 Claims, 6 Drawing Sheets

$$R = \frac{\text{2nd-PHASE VOLUME FRACTION OF REGION FROM SURFACE TO 1/4 DEPTH}}{\text{2nd-PHASE VOLUME FRACTION OF REGION FROM 1/4 DEPTH TO CENTER}}$$

HIGH TENSILE STEEL SHEET HAVING EXCELLENT STRETCH FLANGING FORMABILITY

BACKGROUND OF THE INVENTION

1. Field of the Invention

This invention relates to a high strength steel sheet which is resistant to rupture or generation of cracks at sheet end surfaces during hole expansion by punching or the like. Such a steel sheet is referred to herein as one having excellent stretch flanging formability.

2. Description of the Related Art

Nowadays, a weight reduction by strengthening is an important characteristic of steel sheets intended to be exposed to working.

To strengthen a steel sheet intended for working, a 2nd-phase strengthening method is generally employed which utilizes the so-called 2nd phase of the steel sheet. Such a 2nd-phase-strengthened steel excels not only in balance between strength and ductility but also in such properties as yield ratio (YR=YS/TS) and long life, where YR means yield ratio, YS means yield strength and TS means tensile strength.

A problem with such conventional 2nd-phase-strengthened steels is that when they are subjected to press working involving stretch flanging, as in the case of hole expansion, they are subject to rupture due to cracks generated in their end surfaces because they do not have sufficient stretch flanging formability.

As a means for overcoming the problem a method has been proposed in Japanese Patent Laid-Open No. 61-48520, comprising a combination of reduction in the 2nd phase, minute distribution thereof, improvement in surface properties, etc. However, such a combination of optimized factors only results in complication of the process control procedures. Moreover, it does not help to prevent distortion from being introduced into the 2nd-phase, which distortion constitutes a deteriorating factor of stretch flanging formability. Thus, no great improvement could be expected from the proposed method.

SUMMARY OF THE INVENTION

It is accordingly an object of this invention to provide a high tensile steel sheet excelling in stretch flanging formability in which an important problem confronting conventional 2nd-phase-strengthened steels i.e., poor stretch flanging formability, is overcome while retaining other advantages of conventional 2nd-phase-strengthened steel sheets. Another object of this invention is to provide an advantageous method of producing such an improved steel sheet.

Conventionally, deterioration of stretch flanging formability has been deemed inevitable in a 2nd-phase-strengthened steel sheet because of the presence of local residual stresses which cause the steel sheet to generate cracks during stretch flanging.

We have now discovered that deterioration of stretch flanging formability can be mitigated and overcome by controlling the density distribution of the 2nd phase as it extends out from the center and to the outer surface of the sheet, in the direction of sheet thickness The target characteristic values in the present invention is and index value which allows the product of the hole expansion ratio obtained by the test described below and the square of TS ($TS^2 \times$ hole extension ratio) to be $24.0 \times 10^4$%·kgf$^2$/mm$^4$ or more. Apart from this, characteristic values are desirable which satisfy the following conditions: TS $\geqq 35$ (kg/mm$^2$), $TS \times El \geqq 1600$ (kgf/mm$^2$·%), and $YR \geqq 70$ (%), and, further, in the case of a cold-rolled steel sheet, the condition: r-value $\geqq 1.6$.

DETAILED DESCRIPTION OF PREFERRED EMBODIMENTS

Figure 1:
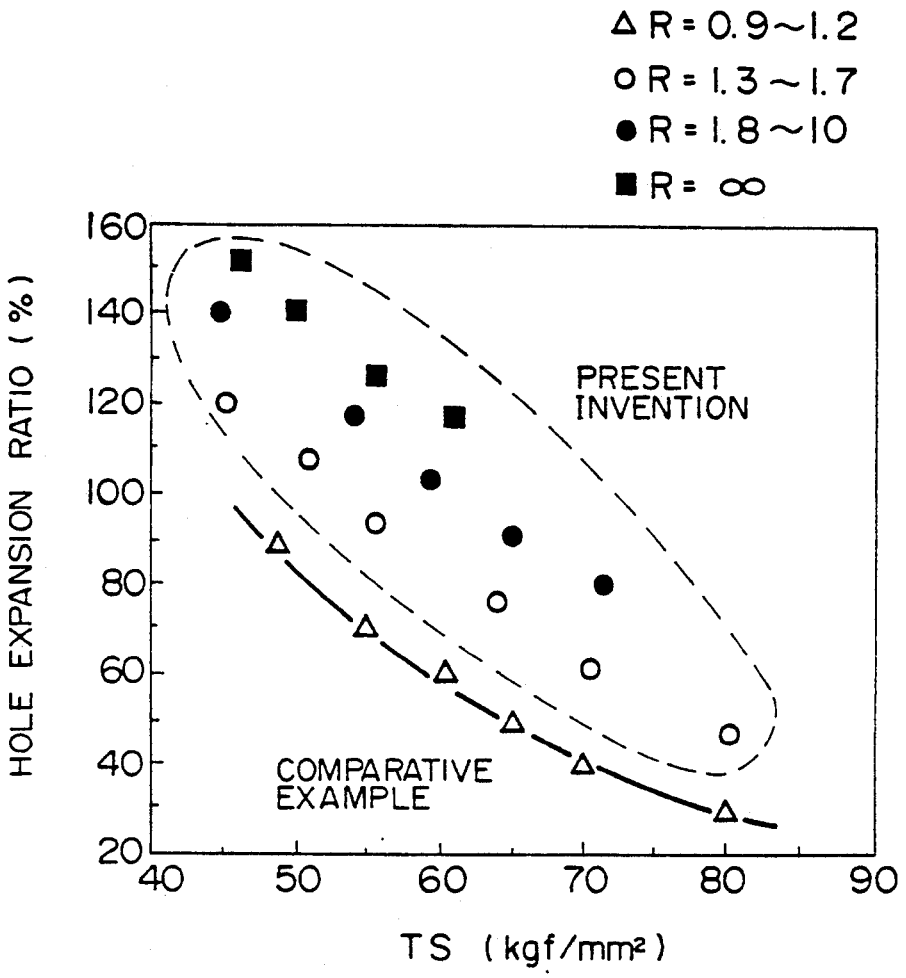
FIG. 1 is a graph showing the balance between TS and stretch flanging formability in steel sheets, using as a parameter the ratio of the 2nd-phase volume fraction of a region adjacent the surface of the steel to the 2nd-phase volume fraction of a region adjacent the thickness center of the steel.

It has been discovered that the foregoing advantages can be attained by providing a second-phase-strengthened steel in which the concentration of the second phase is arranged in a localized configuration in relation to the surface area of the steel sheet and its center.

More particularly this invention contemplates that a steel sheet, taken in cross section, has an inner region near its center and an outer region closer to its surface. As used in this specification and in the claims, the "outer region" is the one which extends from the sheet surface to a mid-location halfway between the sheet surface and the center of the sheet. Conversely, the "inner region" is the one which extends from the center of the sheet to said mid-location which is positioned halfway between the sheet surface and the center of the sheet. According to this invention the steel comprises a composite texture including (A) a ferrite phase and (B) a second phase which comprises individually or in combination martensite, bainite, pearlite, retained austenite or low-temperature transformed ferrite, the latter having important strengthening characteristics as compared to the ferrite phase (A).

The distribution of the second phase (B) across a cross section of the steel sheet is of critical importance according to this invention. Specifically, the second phase (B) is present in a greater amount in the "outer region" than in the "inner region." The ratio between the volume fraction of the second phase in the "outer region" to the volume fraction of the second phase in the "inner region" is hereinafter designated as the ratio R, and is at least 1.3 or higher in accordance with this invention.

The results of a basic experiment which led to the development of a high tensile steel sheet of the present invention will now be described. Description of this example is not intended to define or to limit the scope of the invention.

TEST CONDITIONS

Composition: 0.0025 to 0.0036 wt% of C (0.04 to 0.08 wt % of C, in the case of a non-carburized steel for comparison); 0.01 to 0.30 wt % of Si; 0.5 to 2.0 wt % of Mn; 0.01 to 0.05 wt % of P; 0.005 wt % of S; 0.03 to 0.05 wt % of Al; 0.04 wt % of Ti; and 0.0030 wt % of N ($Ac_1$ transformation point: 850 to 910° C.)

Processes::

(1) Continuous casting (2) Hot rolling: Slab heating temperature (SRT): 1200° C.
Hot-rolling end temperature(FDT): 900° C.
Coiling temperature (CT): 650° C.
Final sheet thickness: 3.0 mm (3) Cold rolling: Final sheet thickness: 0.75 mm (Reduction: 75%)

(4) Continuous annealing:
Heating temperature: 800 to 850° C.
Carburization: for 2 minutes in an atmosphere containing CO (0.5 to 25% of CO, 1 to 10% of $H_2$, the remaining portion being $N_2$, dew point: −40° C. or less) at a temperature of 600 to 900° C. An atmosphere containing no CO was also used for comparison.
Cooling rate: 40° C./sec (5) Temper rolling: Reduction: 0.7%.

In the above experiment, those examples which had been subjected to high-temperature carburization developed, in their carburized portions, an austenite ($\gamma$) having a relatively high C-concentration. As a result, the 2nd-phase volume in the steel was enabled to become more concentrated in the region adjacent the surface of the steel sheet than in the region adjacent the thickness center. In this experiment the rate at which cooling was effected after carburization was 40° C./sec, with the result that the 2nd phase consisted of bainite or a combination of bainite and martensite.

The steel sheets obtained in this experiment were also examined for the relationship between tensile strength (TS) and stretch flanging formability. The results of the examination are shown in FIG. 1, in which the symbol R represents the ratio of the 2nd-phase volume fraction of the "outer region" or near-surface region of the steel (which is the region extending from the surface of the steel sheet to a depth of one-quarter of the sheet thickness) to the 2nd-phase volume fraction of the "inner region" or the near-central region (which is the region extending from the depth of one-quarter of the sheet thickness to the sheet thickness center).

The volume fraction R of each phase was obtainer by optical microscope imaging. The evaluation of the hole extension ratio of the sheet was based upon the enlargement ratio achieved when a circular hole 20 mm in diameter was reamed with a semispherical punch having a radius of 50 mm and such reaming was continued until cracks were generated in the steel sheet.

As is apparent from FIG. 1, the larger the value of R, that is, the more localized the 2nd phase was in the "outer region" or near-surface region, the more linear and well-balanced was the relationship between tensile strength and stretch flanging formability. In FIG. 1 of the drawings the expression $R=\infty$ means that there is no 2nd phase in the "inner region," or the portion near the center of the sheet, and that the "inner region" consists of a single-phase texture of ferrite ($\alpha$). In this case the balance between tensile strength and stretch flanging formability was most excellent, although the tensile strength of the sheet had a tendency to be somewhat low.

To obtain a stretch flanging formability superior to that of the conventional composite-texture steel sheets f it is necessary for the 2nd-phase volume fraction of the "outer region" or the near-surface region to be not less than about 1.3 times higher than the 2nd-phase volume fraction of the "inner region" or the near-central region.

It is not entirely clear why the localized arrangement of the 2nd-phase, with emphasis upon concentration toward the surface of the sheet leads to a marked improvement in stretch flanging formability of the sheet. It is assumed, however, that a significant change of residual stress distribution plays a significant role.

Apart from the martensite and bainite mentioned above, in another case where pearlite or residual $\gamma$ low-temperature-transformed ferrite constituted the 2nd phase, a similar improvement of stretch flanging formability was observed.

It is also believed that controlling of the carburizing rate plays an important role in obtaining an advantageous 2nd-phase distribution ratio R in accordance with this invention.

Figure 2:
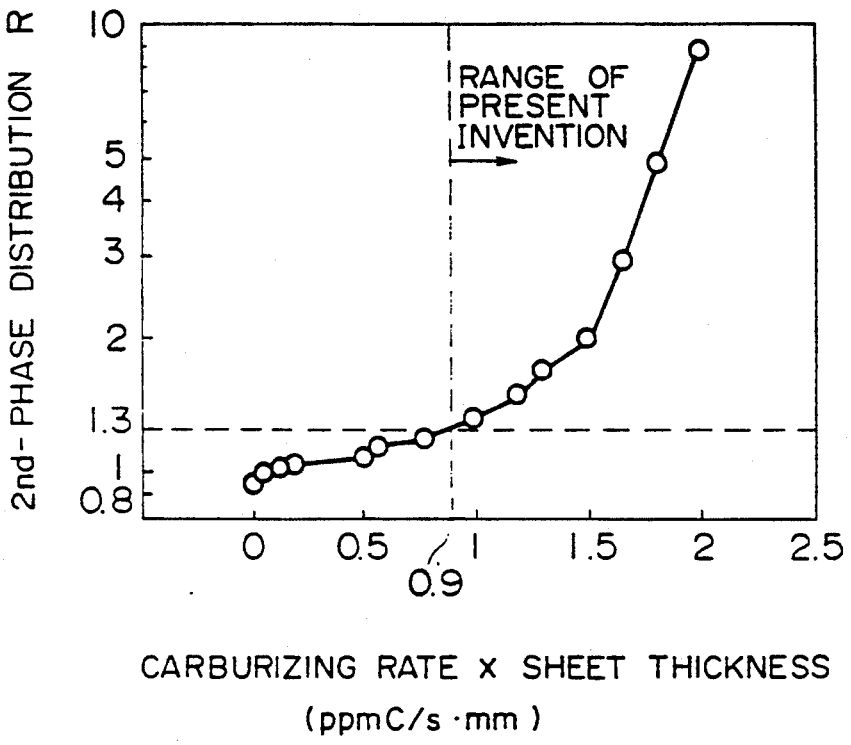
FIG. 2 is a diagram showing the relationship between the carburizing rate and the 2nd-phase distribution of the steel.

FIG. 2 of the drawings shows a relationship between carburizing rate and 2nd-phase distribution R. There, the carburizing rate (ppmC/sec) is defined as the average rate of increase of the C-content (%) in the steel with respect to the total sheet thickness (t) (mm). It is clear from FIG. 2 that it is essentially impossible to obtain an R value of 1.3 or more unless the value of (carburizing rate)×(sheet thickness) (ram) is about 0.9 or more, that is, unless the carburizing rate is about 0.9/(sheet thickness) or more. Table 1 shows the relationship between (carburizing rate)×(sheet thickness) (mm) and R with respect to a steel sheet with which it is impossible to obtain a 2nd phase without effecting carburization (which has the composition: 0.0020 wt % of C; 0.1 wt % of Si; 0.7 wt % of Mn; 0.04 wt % of P; 0.010 wt % of S; 0.045 wt % of Al; 0.03 wt % of Ti; and 0.0025 wt % of N).

TABLE 1

| Carburizing Rate × Sheet Thickness (ppmC/sec) · (mm) | 0 | 0.5 | 0.8 | 0.9 | 1.2 | 2.5 | 5.0 |
|---|---|---|---|---|---|---|---|
| 2nd Phase Volume Fraction Near Surface (%) | 0 | 0 | 0 | 2 | 3 | 4 | 9 |
| 2nd Phase Volume Fraction of Central Region (%) | 0 | 0 | 0 | 0 | 0 | 0 | 1 |
| Volume Fraction Ratio R | — | — | — | ∞ | ∞ | ∞ | 9 |

As can be seen from Table 1, no 2nd phase appears near the surface of the above steel sheet unless the value of the product of (carburizing rate)×(sheet thickness) (mm) is about 0.9 or more, that is, unless the carburizing rate is not less than 0.9 divided by the sheet thickness.

Further, it has been found that with such a steel sheet having a localized 2nd-phase distribution, a further improvement can be achieved in terms of ductility and stretch flanging formability by subsequently retaining it in an atmosphere at a temperature within the range of about 150 to 550° C. for 30 seconds or more.

The reason for this phenomenon will be explained on the basis of the results of a further experiment which is detailed as follows:

TEST CONDITIONS

Composition: 0.0042 wt % of C; 0.5 wt % of Si; 1.2 wt % of Mn; 0.07 wt % of P; 0.005 wt % of S; 0.036 wt % of Al; 0.04 wt % of Ti; and 0.0025 wt % of N (Ac transformation point: 920° C.)

Processes:

(1) Continuous casting (2) Hot rolling: Slab heating temperature (SRT): 1200° C. Hot-rolling end temperature(FDT): 900° C.

Coiling temperature (CT): 600° C.

Final sheet thickness: 3.5 mm (3) Cold rolling: Final sheet thickness: 0.9 mm (Reduction: 74%)

(4) Continuous annealing:

Heating temperature: 850° C.

Carburization: for 2 minutes in an atmosphere containing CO (containing 20% of CO, 20% of $H_2$, the remaining portion being $N_2$, dew point: −40° C. or less) at a temperature of 910° C.

Carburizing rate: 2.1 ppm C/sec.

Primary cooling rate: 50° C./sec

Primary-cooling-end-point temperature: 50 to 800° C.

Retention time after primary cooling: 150 sec.

Retention temperature after primary cooling: retained in conformity with the end-point temperature.

Secondary cooling rate: 30° C./sec.

(5) Temper rolling: Reduction: 1.0%.

Cold-rolled sheets were produced under the above conditions.

Figure 3:
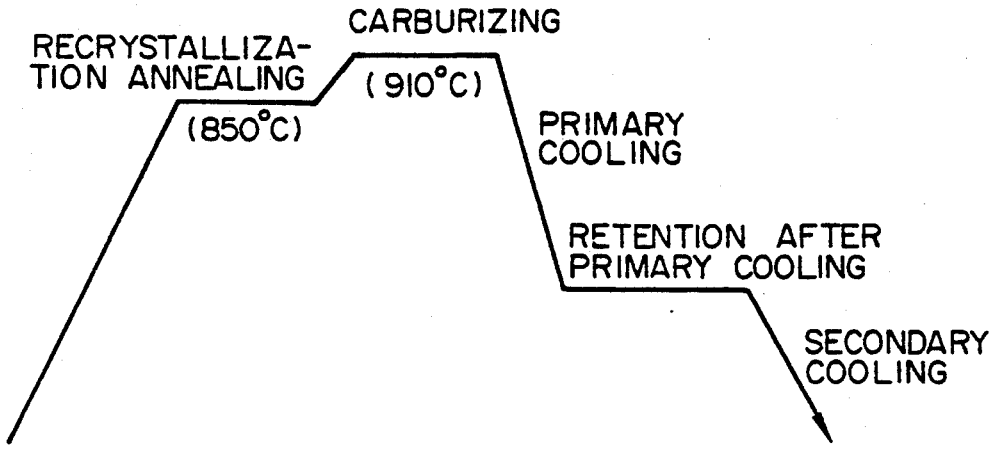
FIG. 3 shows an example of a heat-treatment cycle in the practice of the present invention.
Figure 5:
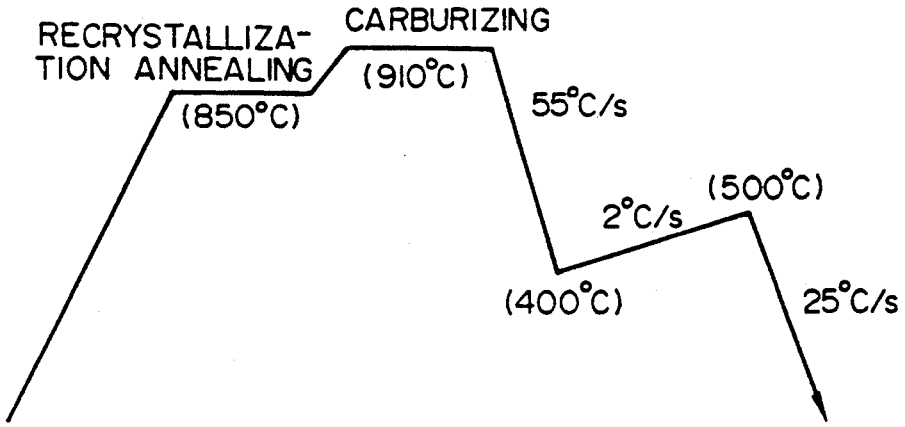
FIG. 5 shows another example of heat-treatment cycle in the practice of present invention.

FIG. 3 is a schematic diagram showing the processing conditions in this experiment.

In this experiment, those steel sheets which had undergone high-temperature carburization had a 2nd phase consisting of bainite and martensite. Further, the ratio R of the 2nd-phase volume ratio was 5 at the retention temperature after primary cooling of 50 to 700° C. and 3 at the conventional retention temperature after cooling of 800° C.

Figure 4:
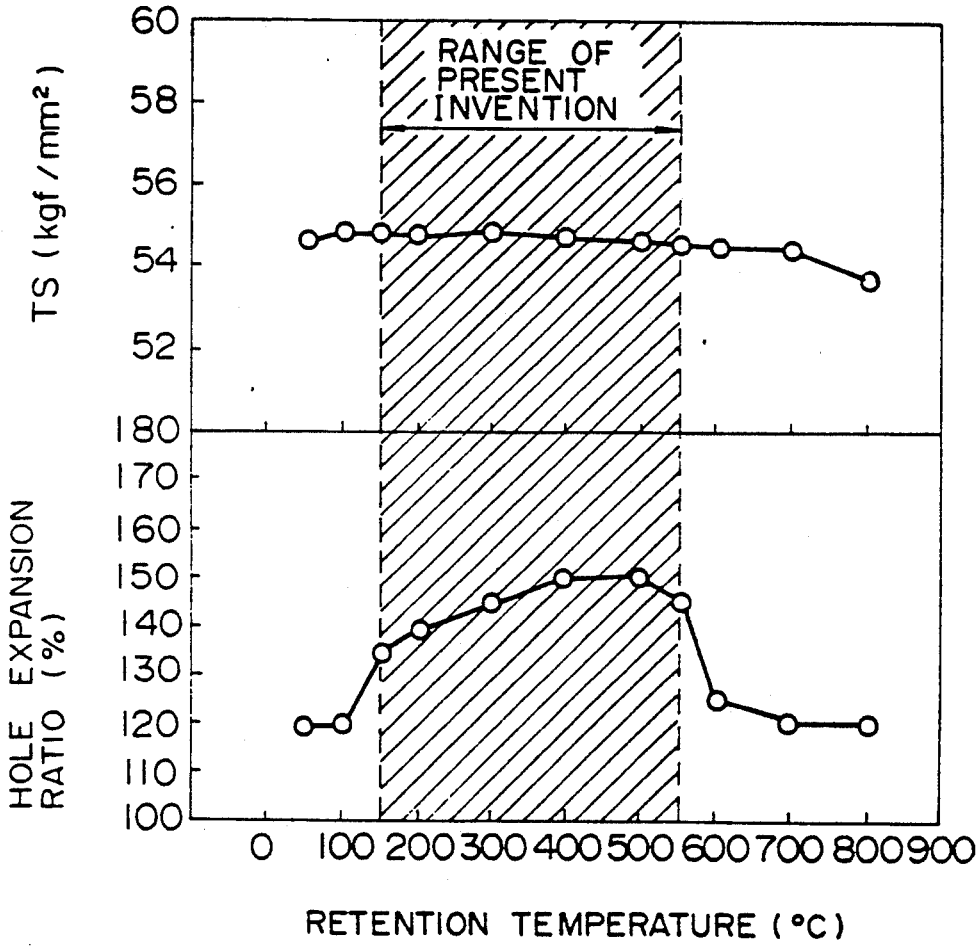
FIG. 4 is a diagram showing an effect attained by low-temperature retention after carburization of the steel.

FIG. 4 shows the influence of the retention temperature after primary cooling on the tensile strength of the sheet and its stretch flanging formability. As can be seen from this drawing, when the retention temperature after primary cooling was within the range of about ! .50 to 550° C., both tensile strength and stretch flanging formability were stable, the relationship between the two being better-balanced as compared to when there was no retention processing after primary cooling.

Further, also with cold-rolled steel sheets of the same type as described above, obtained through similar processes and, after that, subjected to a low-temperature retention process which was not of a uniform-heating type, a tensile strength of 59.0 kgf/mm$^2$ and a hole expansion ratio of 150% was obtained, thus realizing a well-balanced relationship between tensile strength and stretch flanging formability. However, it was found that with a uniform-heating time of about 30 seconds or less, such effects could not be obtained and, on the other hand, use of a uniform-heating time of more than about 300 seconds lead to tempering, resulting in a significant and undesirable strength reduction. Accordingly, the uniform-heating time must be in the range of about 30 to 300 seconds.

It remains to be determined exactly why a further improvement in stretch flanging formability can be achieved by the novel low-temperature retention process. However, it is assumed that the inner-stress distribution within the sheet approaches uniformity by stimulating rearrangement the dissolved C, which is present at solid-solution positions not allowing the low-temperature retention after carburization to be effected in a stable manner. Further, in this uniform-heating process, a strength reduction as experienced in conventional tempering is practically not to be observed. Thus, it is deemed to be a phenomenon different from the separation of excess C in ordinary tempering processes.

Next, composition ranges for steel sheets to which the present invention can be suitably applied will be described.

C: about 0. 004 to 0.2 wt %

In the present invention, there is a reduction in the content of C in the region of the steel sheet corresponding to the center of the sheet thickness, thereby suppressing generation of the 2nd phase. On the other hand, in the region of the steel sheet which is near the sheet surface, it is necessary to augment the content of C so as to positively generate the 2nd phase. For that purpose it is advantageous, as shown in the aforementioned experimental results, to set the C-content in the initial composition of the steel at about 0.009 wt % or less afterwards, increasing the C-content in the near-surface region to a level of about 0.01 to 0.5 wt % by carburization.

The C-content of the steel cannot always be definitely determined. In any case, a C-content which is less than about 0.004 wt % is not only uneconomical to produce but also adversely affects the formation of the 2nd phase. A C-content in excess of about 0.2 wt %, on the other hand, tends to make the steel ductility and non-aging properties liable to degeneration. Thus, a preferable C-content ranges from about 0.004 to 0.2 wt %.

As shown in the foregoing results, when a hot-rolled or a cold-rolled steel sheet is obtained from a steel whose C-content is 0.009 wt % or less and whose composition satisfies the condition: $(12/48)Ti^* - (12/93)Nb \geqq C$ (where $Ti^* = Ti - (48/32)S - (48/14)N$), ensuring the requisite ductility and deep drawability, and then strength increase and stimulation of 2nd-phase generation are effected by carburization, exceptional workability can be obtained. With the steel sheet of the present invention, a C-content of about 0.009 wt % or less provides a satisfactory deep drawability.

Si: about 2.0 wt % or less

A necessary amount of Si is added as a reinforcing and 2nd-phase stabilizing element. An Si-content in excess of about 2.0 wt % results in increase of the transformation point to necessitate high-temperature annealing; accordingly an Si-content of about 2.0 wt % or less is desirable.

Mn: about 3.5 wt % or less

A necessary amount of Mn is added as a reinforcing and 2nd-phase stabilizing element. An Mn-content in excess of about 3.5 wt % tends to cause a deterioration of balance between elongation and strength, so an Mn-content of about 3.5 wt % or less is desirable.

P: about 0.25 wt % or less

A necessary amount of P is added as a reinforcing element. A P-content in excess of about 0.25 wt % tends to make conspicuous the surface defects due to segregation, so a P-content of about 0.25 wt % or less is desirable.

S: about 0.10 % or less

An S-content in excess of about 0.10% tends to cause deterioration of hot workability and a reduction of yield of Ti-addition described below, so an S-content of not more than about 0.10% is desirable.

N: about 0.0050 % or less

An N-content in excess of about 0.0050 % results in a deterioration of workability and non-aging properties at room temperature, so an N-content of about 0.0050 % or less is desirable.

Ti and/or Nb: about 0.002 to 0.2 wt %

Both Ti and Nb not only serve as reinforcing elements but also help to fix the dissolved C, N and S in the ferrite phase, thereby effectively contributing to improvement of workability. However, if the content of these elements is less than about 0.002 wt %, no substantial effect is thereby obtained. On the other hand, a content of these elements which is in excess of about 0.2 wt % results in the addition reaching saturation, which is disadvantageous from the economic point of view. Thus, whether one or both of these elements are added, it is desirable that the content be in the range of about 0.002 to 0.2 wt %.

Further, as stated above, when a hot-rolled, a cold-rolled or an annealed steel sheet is obtained from a steel material whose initial composition satisfies the condition of about: $(12/48)Ti^* - (12/93)Nb \geqq C$ (where $Ti^* = Ti - (48/32)S - (48/14)N$), with the dissolved C, N and S being removed therefrom, and is then subjected to carburization, it is possible to obtain a steel sheet excellent in ductility and deep drawability.

Mo: about 0.03 to 5.0 wt %

Cr, Ni, Cu: about 0.1 to 5.0 wt % each

B: about 0.0002 to 0.10 wt %

Mo, Cr, Ni, Cu and B are all elements which are effective in augmenting the strength of a steel sheet. If the added amounts of these elements are short of the respective lower limits given above, desired strength cannot be obtained. If, on the other hand, the added amounts of these elements exceed the respective upper limits, the quality of the material deteriorates, so it is desirable for these elements to be added in amounts within their respective ranges as given above.

To obtain a composite texture steel sheet having martensite and/or bainite as the 2nd phase, it is normally desirable to set the rate of cooling after carburization, which is conducted at about 500° C. or more, at about 30° C./sec or more. In particular, when the condition: $Mn + 3\,Mo + 2\,Cr + Ni + 10\,B \geqq 1.5$ is satisfied, a cooling rate of approximately 10° C./sec or more suffices for the temperature range of about 500° C. or more.

Next, a production method in accordance with this invention will be described in procedural sequence.

(1) The slab is produced by ordinary continuous casting or ingot-making.

(2) Hot rolling may be terminated at the $Ar_3$ transformation point or beyond. Apart from that, a warm rolling method, on which attention is being focused nowadays, may alternatively be adopted. There is no particular limitation regarding coiling temperature.

(3) The steel sheets obtained by hot rolling or warm rolling are immediately subjected to carburization except for those sheets designated to be cold-rolled.

(4) As for the hot-rolled or warm-rolled steel sheets which have not undergone carburization, cold rolling is performed to make cold-rolled steel sheets, which are further subjected to recrystallization annealing before undergoing carburization. An appropriate annealing temperature is about 700 to 950° C. An annealing temperature below about 700° C. results in insufficient recrystallization. On the other hand, an annealing temperature higher than about 950° C. often results in the sheet being transformed over the entire thickness thereof prior to carburization even in the case of a low-carbon or ultra-low- carbon interstitial free (IF) steel having a high Ac transformation point, in which case the steel sheet obtained is not much different from ordinary composite-texture steels.

As for the initial composition of the steel sheet, it is expedient to adopt one which has an ultra-low C-content of about 0. 009 wt % or less and which satisfies the following condition: $(12/48)Ti^* - (12/93)Nb \geqq C$ (where $Ti^* = Ti - (48/32)S - (48/14)N$), and then to perform recrystallization annealing in such a way as to allow substantially no dissolved C to be present. This arrangement is advantageous in obtaining a steel sheet having a very high r-value, and also provides satisfactory workability.

In view of this, an initial material composition was adopted which satisfied the approximate conditions: $C \leqq 0.009$ wt % and $(12/48)Ti^* - (12/93)Nb \geqq C$ (where $Ti^* = Ti - (48/32)S - (48/14)N$).

Since the necessary conditions regarding carburizing rate in the carburization process and the effect of low-temperature retention after carburization have already been stated, other different restricting factors will now be mentioned.

In the method of the present invention, the carburization temperature is established in the approximate range of: (Ac transformation point − 50° C.) to ($Ac_1$ transformation point + 30° C.). This is because the formation of the 2nd phase becomes difficult when the carburization temperature is lower than the lower limit of the above temperature range and, on the other hand, a carburization temperature beyond the upper limit is also undesirable since the 2nd phase is then dispersed over the entire area of the sheet thickness, thereby making it difficult to effect a localized formation of the 2nd phase at or near the surface region.

It is desirable that the Ac transformation point of the initial material be actually measured. However, it is also possible to use a calculated $Ac_1$ transformation point which can be calculated in a simple manner from certain of the components of the steel, using the following formula which was discovered by the present inventors:

$$Ac_1(^\circ C.) = 945 - 1000\,C(wt\,\%) + 70\,Si(wt\,\%) - 56\,Mn(wt\,\%) + 250\,P(wt\,\%) + 25\,Mo(wt\,\%) - 30\,Cr(wt\,\%) - 80\,Ni(wt\,\%) - 40\,Cu(wt\,\%) + 1700\,B(wt\,\%)$$

Further, it can be seen from this formula that if carburization is started at a temperature not higher than the $Ac_1$ transformation point of the initial material, lowering of $Ac_1$ transformation point due to the C-content occurs at the near-surface region during carburization, resulting in a substantial amount of 2nd phase being generated in the near-surface region of the steel.

Figure 6:
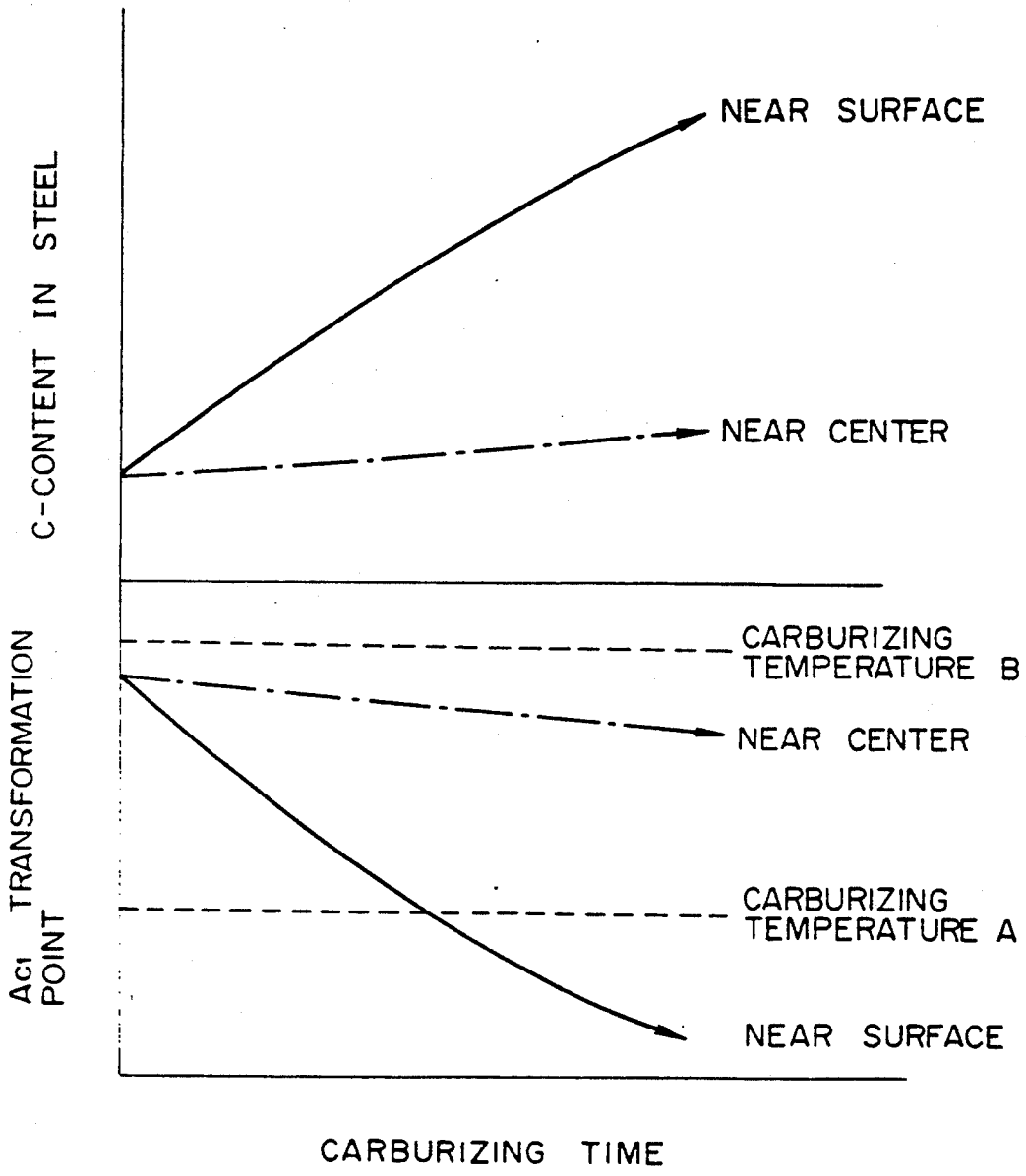
FIG. 6 is a schematic diagram showing a principle by which a predetermined 2nd-phase distribution can be obtained in accordance with the method of this invention.
Figure 7A:
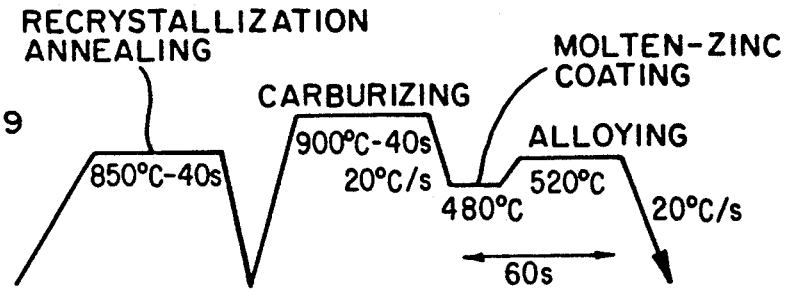
FIGS. 7(*a*), 7(*b*), 7(*c*), 7(*d*) and 7(*e*) show heat-treatment cycles according to Symbols No. 9 through 13 to be discussed further hereinafter.
Figure 7B:
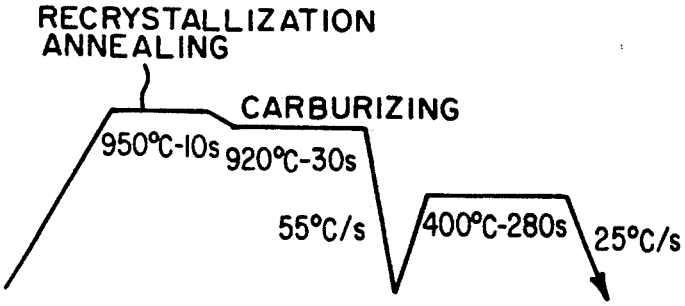
Figure 7C:
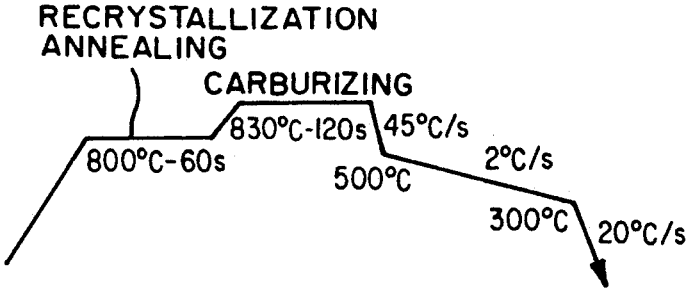
Figure 7D:
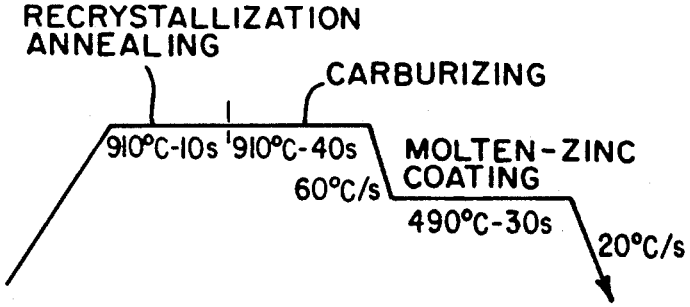
Figure 7E:
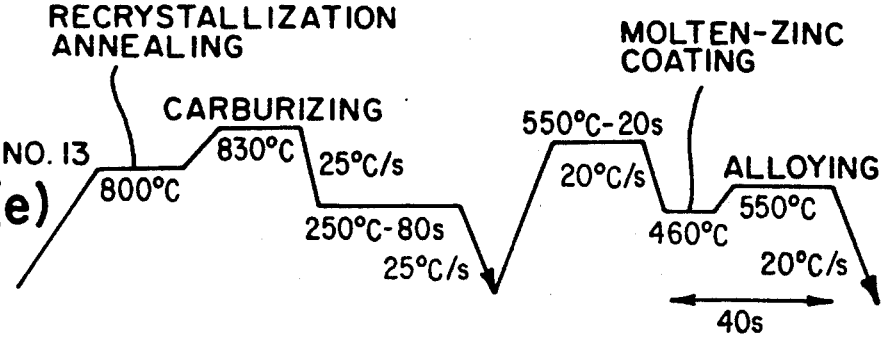

That is, as is schematically shown in FIG. 6, the C-content of the steel increases in the region near the steel surface as a result of carburization, resulting in lowering of the $Ac_1$ transformation point of that region as compared to the Ac transformation point of the region near the thickness center. As a result, carburization at a temperature lower than the Ac transformation point of the initial material (the carburizing temperature A in the drawing) results in the 2nd phase appearing in the near-surface region of the steel sheet only. Also, carburization effected at a temperature higher than the $Ac_1$ transformation point of the initial material (the carburizing temperature B in the drawing) results in a large amount of 2nd phase appearing because the temperature difference from the $Ac_1$ transformation point is relatively large in the near-surface region.

To effect carburization to a sufficient degree, it is necessary for the carburization to be performed for about 15 seconds or more (preferably about 300 seconds or less).

Effective means of carburization include application of a carbon-containing liquid, introduction of a carburizing gas (CO, CH4 or the like) into the atmosphere inside the furnace, or direct feeding of a volatile carbon-containing liquid into the furnace.

To obtain a high r-value, it is advantageous to conduct carburization after termination recrystallization annealing rather than to conduct it during recrystallization annealing although the former case involves a lengthening of the process.

It is necessary for the rate of cooling after carburization to be about 10° C./sec or more. A cooling rate lower than this makes it difficult to effect reinforcement of the steel by the 2nd phase. Moreover, it tends to promote uniform distribution of the 2nd phase in the thickness direction of the sheet.

It is expedient for the end point temperature oil the cooling process to be about 500° C. or less. If uniform heating or slow cooling is started at a temperature not lower than that, reinforcement of the steel by the 2nd phase is difficult to effect as in the case where the cooling rate is rather low. Further, the thickness distribution of the 2nd phase in the sheet tends to be uniform.

Temper rolling is not absolutely necessary. However, a pressure of approximately 3% or less may be applied as needed to rectify the sheet configuration.

Further, it is also possible to use the steel sheet of this invention after subjecting it to a surface coating process such as hot-dip zinc-coating.

EXAMPLES

Using various materials and compositions as shown in Table 2 (according to the present invention and comparative examples) as initial materials, many runs were conducted in which steel sheets were produced under the conditions stated in Tables 3(1) and 3(2). The final thickness of the cold-rolled steel sheets was 0.75 mm, and the maximum-temperature retention time in continuous annealing step was 20 seconds.

The steel sheets thus obtained were examined for mechanical properties. The results of the examination are given in Tables 4(1) and 4(2).

TABLE 2

| No. | Chemical Composition (%) C | Si | Mn | P | S | N | Al | Ti | Nb | Others | {(12/48)Ti* + (12/93)Nb}/C | Mn + 3Mo + 2Cr + Ni + 10B | $Ac_1$ Transformation point** (°C.) | Classification |
|---|---|---|---|---|---|---|---|---|---|---|---|---|---|---|
| 1 | 0.0025 | 0.05 | 2.50 | 0.051 | 0.005 | 0.0023 | 0.048 | 0.043 | — | — | 4.30 | 2.50 | 819 | Present invention |
| 2 | 0.0450 | 0.05 | 2.51 | 0.050 | 0.006 | 0.0028 | 0.051 | 0.040 | — | — | 0.22 | 2.51 | 775 | Comparative example |
| 3 | 0.0018 | 0.01 | 0.52 | 0.012 | 0.003 | 0.0020 | 0.021 | 0.030 | 0.008 | B 0.0030 | 4.74 | 0.55 | 923 | Present invention |
| 4 | 0.0045 | 0.11 | 0.80 | 0.015 | 0.006 | 0.0022 | 0.051 | 0.060 | — | Mo 0.2, Cr 0.5, Ni 0.5 | 3.33 | 2.90 | 857 | |
| 5 | 0.0044 | 0.01 | 0.40 | 0.010 | 0.007 | 0.0041 | 0.060 | 0.054 | — | Cr 0.1, Ni 0.1 | 3.07 | 0.70 | 910 | |
| 6 | 0.0034 | 1.80 | 0.20 | 0.110 | 0.020 | 0.0027 | 0.054 | 0.012 | 0.033 | Ni 2.3 | 2.13 | 4.80 | 900 | |
| 7 | 0.0100 | 0.10 | 1.00 | 0.016 | 0.006 | 0.0025 | 0.061 | 0.063 | — | Mo 0.3, Cr 0.8, Ni 0.5 | 1.13 | 4.00 | 834 | Comparative example |
| 8 | 0.0025 | 0.01 | 1.20 | 0.005 | 0.005 | 0.0026 | 0.054 | 0.035 | — | Cr 0.3 | 1.86 | 1.80 | 877 | Present invention |
| 9 | 0.0056 | 0.51 | 1.03 | 0.056 | 0.011 | 0.0020 | 0.049 | 0.051 | — | Mo 0.4, B 0.0010 | 1.23 | 2.24 | 943 | |
| 10 | 0.0018 | 1.02 | 1.49 | 0.10 | 0.025 | 0.0023 | 0.039 | 0.050 | 0.012 | B 0.0030 | 1.50 | 1.52 | 961 | |
| 11 | 0.0075 | 0.31 | 0.20 | 0.073 | 0.009 | 0.0026 | 0.040 | 0.063 | — | Cu 1.0, Ni 0.5 | 1.35 | 1.70 | 830 | |
| 12 | 0.0032 | 0.42 | 0.78 | 0.085 | 0.010 | 0.0018 | 0.074 | — | 0.030 | — | 1.21 | 0.78 | 949 | |
| 13 | 0.0022 | 0.14 | 2.00 | 0.062 | 0.002 | 0.0026 | 0.036 | 0.040 | 0.005 | Cr 0.5 | 3.48 | 2.00 | 836 | |

Note:
Carbon contents are those prior to carburization.
Ti* = Ti - (48/32) S - (48/14) N
Underlined items are out or appropriate range.
** = 945-1000° C. (wt %) + 70 Si (wt %) − 56 Mn (wt %) + 250 P (wt %) + 25 Mo (wt %) − 30 Cr (wt %) − 80 Ni (wt %) − 40 Cu (wt %) + 1700 B (wt %)

TABLE 3(1)

| Symbol | Hot Rolling Conditions SRT (°C.) | FDT (°C.) | CT (°C.) | Cold Rolling Reduction (%) | $Ac_1$ Transformation Point (°C.) | Annealing Temperature (°C.) | Curburizing Conditions: Carburizing Means | Carburizing Temperature (°C.) | Curburizing Rate (s) | Cooling Rate (°C./s) |
|---|---|---|---|---|---|---|---|---|---|---|
| 1A | 1200 | 890 | 600 | — | 819 | — | Appln. of NaCN | 800 | 100 | 50 |
| 1B | 1200 | 890 | 600 | 75 | 819 | 760 | Appln. of | 800 | 100 | 50 |
| 1C | 1200 | 890 | 600 | 75 | 819 | 760 | rolling | 760 | 100 | 50 |
| 1D | 1200 | 890 | 600 | 75 | 819 | 760 | oil | 880 | 100 | 50 |

TABLE 3(1)-continued

| | | | | | | | | | | |
|---|---|---|---|---|---|---|---|---|---|---|
| 1E | 1200 | 890 | 600 | 75 | 819 | — | | 800 | 100 | 50 |
| 1F | 1200 | 890 | 600 | 75 | 819 | 760 | — | 800 | 100 | 50 |
| 2 | 1200 | 880 | 600 | 75 | 775 | 760 | — | 800 | 100 | 50 |
| 3 | 1150 | 880 | 650 | 78 | 923 | 850 | Acetone into furnace | 930 | 30 | 40 |
| 4A | 1250 | 880 | 500 | 70 | 857 | 820 | 10% $CH_4$ gas | 860 | 60 | 15 |
| 4B | 1250 | 880 | 500 | 70 | 857 | 820 | 30% $CH_4$ gas | 860 | 30 | 30 |
| 5A | 1250 | 880 | 500 | 70 | 910 | 820 | 30% $CH_4$ gas | 860 | 60 | 80 |
| 5B | 1250 | 880 | 500 | 70 | 910 | 820 | 30% $CH_4$ gas | 860 | 60 | 15 |
| 6 | 1250 | 920 | 450 | 70 | 900 | 860 | 10% $CH_4$-30% CO gas | 860 | 180 | 5 (≧650° C.) 90 (≦650°0 C.) |

| Symbol | Others | Temper Rolling (%) | Classification |
|---|---|---|---|
| 1A | Hot rolled sheet | 0.5 | Present invention |
| 1B | | 0.5 | |
| 1C | | 0.5 | Comparative example |
| 1D | | 0.5 | |
| 1E | Carburization during annealing | 0.5 | Present invention |
| 1F | | 0.5 | Comparative example |
| 2 | Excessive C with remaining dissolved C | 0.5 | |
| 3 | Hot dip galvanizing (480° C.) | 0.8 | Present invention |
| 4A | | Nil | |
| 4B | | Nil | |
| 5A | | Nil | |
| 5B | | Nil | |
| 6 | 400° C. for 350 s | 0.2 | |

Note:
Underlined items are out of appropriate range. The remaining gas in gas carburization entirely consists of $N_2$ gas.

TABLE 3(2)

| | Hot Rolling Conditions | | | Cold Rolling | $Ac_1$ Transformation | Annealing | Curburizing Conditions | | | |
|---|---|---|---|---|---|---|---|---|---|---|
| Symbol | SRT (°C.) | FDT (°C.) | CT (°C.) | Reduction (%) | Point (°C.) | Temperature (°C.) | Carburizing Means | Carburizing Temperature (°C.) | Carburizing time (s) | Cooling Rate (°C./s) |
| 7 | 1250 | 880 | 500 | 70 | 834 | 830 | 30% $CH_4$ gas | 830 | 60 | 30 |
| 8 | 1250 | 900 | 550 | 75 | 877 | 850 | 15% CO-3% $H_2$ | 890 | 50 | 40 |
| 9 | 1200 | 900 | 650 | 80 | 943 | 850 | 30% CO-5% $CH_4$-8% $H_2$ | 900 | 40 | 20 |
| 10 | 1100 | 900 | 550 | 78 | 961 | 950 | 30% CO-5% $CH_4$-8% $H_2$ | 920 | 30 | 55 |
| 11 | 1200 | 900 | 550 | 75 | 830 | 800 | 30% CO-5% $CH_4$-8% $H_2$ | 830 | 120 | 45 |
| 12 | 1150 | 850 | 700 | 68 | 949 | 910 | 20% CO-6% $H_2$ | 910 | 40 | 60 |
| 13 | 1050 | 880 | 600 | 70 | 836 | 800 | 20% CO-6% $H_2$ | 830 | 60 | 25 |

| Symbol | Others | Temper Rolling (%) | Classification |
|---|---|---|---|
| 7 | Excessive C initial composition | Nil | Comparative Example |
| 8 | | 0.5 | Present invention |
| 9 | Hot dip Galvanizing (480° C.) | 0.5 | |
| 10 | 400° C. for 280 sec. | 1.2 | |
| 11 | | 1.0 | |
| 12 | Hot dip galvanizing (490° C.) | 0.5 | |
| 13 | 550° C. for 20 sec. | 0.3 | |

Note:
Underlined items are out of appropriate range.
The remaining gas in gas carburization entirely consists of $N_2$ gas.

TABLE 4(1)

| Symbol | C after Carburization (%) | 2nd Phase | 2nd-phase Volume Fraction of Surface-¼ Depth Region (%) | 2nd-phase Volume Fraction of Surface-¼ Depth-Center Region (%) | R | YS (kgf/mm²) | TS (kgf/mm²) | El (%) | r Value | Hole Expansion Ratio (%) | $TS^2$ × Hole Expansion Ratio ($10^4$% $kgf^2/mm^4$) |
|---|---|---|---|---|---|---|---|---|---|---|---|
| 1A | 0.035 | Martensite | 7 | 2 | 3.5 | 30.0 | 62.1 | 35.5 | 1.3 | 102 | 39.3 |

TABLE 4(1)-continued

| | | | | | | | | | | | |
|---|---|---|---|---|---|---|---|---|---|---|---|
| 1B | 0.033 | Martensite | 10 | 3 | 3.3 | 31.1 | 65.4 | 33.5 | 1.8 | 91 | 38.9 |
| 1C | 0.0053 | — | 0 | 0 | — | 41.5 | 48.6 | 27.8 | 1.5 | 100 | 23.6 |
| 1D | 0.087 | Martensite | 15 | 15 | 1.0 | 38.7 | 70.2 | 28.4 | 1.3 | 39 | 19.2 |
| 1E | 0.033 | Martensite | 12 | 8 | 1.5 | 32.1 | 65.4 | 33.5 | 1.6 | 73 | 31.2 |
| 1F | 0.0025 | — | 0 | 0 | — | 38.8 | 45.3 | 34.2 | 1.8 | 111 | 22.8 |
| 2 | 0.095 | Martensite | 8 | 8 | 1.0 | 33.6 | 65.7 | 30.6 | 1.0 | 48 | 20.7 |
| 3 | 0.011 | Low-temperature-transformed ferrite | 40 | 10 | 4.0 | 25.1 | 42.4 | 48.3 | 2.3 | 147 | 26.4 |
| 4A | 0.024 | Bainite | 12 | 2 | 6.0 | 28.5 | 54.8 | 38.5 | 1.8 | 120 | 36.0 |
| 4B | 0.023 | Bainite | 12 | 0 | ∞ | 26.2 | 50.6 | 41.1 | 2.0 | 142 | 36.4 |
| 5A | 0.026 | Bainite | 10 | 4 | 2.5 | 27.8 | 53.7 | 41.0 | 1.9 | 131 | 37.8 |
| 5B | 0.022 | Bainite | 7 | 5 | 1.4 | 35.7 | 45.9 | 37.4 | 1.7 | 115 | 24.2 |
| 6 | 0.033 | Remaining γ + Bainite | 10 | 3 | 3.0 | 31.2 | 56.7 | 50.7 | 1.8 | 116 | 37.3 |

| Symbol | YR (%) | TS × El (% · kgf/mm²) | YEl (%) | Classification |
|---|---|---|---|---|
| 1A | 48 | 2205 | 0.0 | Present invention |
| 1B | 48 | 2191 | 0.0 | |
| 1C | 85 | 1351 | 3.5 | Comparative example |
| 1D | 55 | 1994 | 0.0 | |
| 1E | 49 | 2191 | 0.0 | Present invention |
| 1F | 86 | 1549 | 0.0 | Comparative example |
| 2 | 51 | 2010 | 0.8 | |
| 3 | 59 | 2048 | 0.0 | Present invention |
| 4A | 52 | 2110 | 0.0 | |
| 4B | 52 | 2080 | 0.0 | |
| 5A | 52 | 2200 | 0.0 | |
| 5B | 78 | 1717 | 0.0 | |
| 6 | 55 | 2875 | 0.0 | |

TABLE 4(2)

| Symbol | C after Carburization (%) | 2nd Phase | 2nd-phase Volume Fraction of Surface-¼ Depth Region (%) | 2nd-phase Volume Fraction of Surface-¼ Depth-Center Region (%) | R (%) | YS (kgf/mm²) | TS (kgf/mm²) | El (%) | r Value | Hole Expansion Ratio (%) | TS² × Hole Expansion Ratio (10⁴% kgf²/mm⁴) |
|---|---|---|---|---|---|---|---|---|---|---|---|
| 7 | 0.028 | Bainite | 15 | 14 | 1.1 | 31.5 | 51.8 | 35.6 | 1.4 | 56 | 15.0 |
| 8 | 0.011 | Bainite + Pearlite | 21 | 0 | ∞ | 23.1 | 42.3 | 44.6 | 1.8 | 153 | 27.4 |
| 9 | 0.037 | Martensite + Bainite | 8 | 2 | 4.0 | 29.4 | 53.4 | 39.5 | 2.2 | 140 | 39.9 |
| 10 | 0.025 | Martensite + Bainite | 6 | 1 | 6.0 | 35.0 | 63.6 | 33.4 | 2.0 | 120 | 48.5 |
| 11 | 0.040 | Martensite | 6 | 3 | 2.0 | 28.1 | 49.9 | 42.8 | 2.3 | 148 | 36.7 |
| 12 | 0.029 | Martensite + Bainite | 8 | 3 | 2.7 | 26.2 | 45.5 | 46.0 | 2.3 | 155 | 32.1 |
| 13 | 0.021 | Bainite | 10 | 2 | 5.0 | 21.8 | 43.4 | 48.7 | 2.4 | 160 | 30.1 |

| Symbol | YR (%) | TS × El (% · kgf/mm²) | YEl (%) | Classification |
|---|---|---|---|---|
| 7 | 61 | 1844 | 0.0 | Comparative example |
| 8 | 55 | 1887 | 0.0 | Present invention |
| 9 | 55 | 2109 | 0.0 | |
| 10 | 55 | 2124 | 0.0 | |
| 11 | 56 | 2136 | | |
| 12 | 58 | 2093 | 0.0 | |
| 13 | 50 | 2114 | 0.0 | |

In Table 4(1), Symbol 1A indicates an example according to the present invention comprising carburization of a hot-rolled steel sheet. Due to the fact that this example was based on a hot-rolled sheet, its r-value was inherently low, but its other characteristics were satisfactory.

Symbol 1B in Table 4(1) indicates an example according to the present invention where the product was obtained by carburization of a cold-rolled steel sheet. With this example all the resulting characteristics were satisfactory.

Symbol 1C in Table 4(1) indicates a comparative example in which the carburizing temperature was below the lower limit of the appropriate temperature range with this example carburization was conducted in the ferrite range, so that it had a rather poor TS−El balance (TS×El) and r-value. Moreover, it had the disadvantages of high yield ratio, generation of yield elongation (YEl>0), etc.

In Comparative Example 1D (Table 4 (1)), the carburization temperature was higher than the upper Limit of the appropriate temperature range. This example (Table 4(1)) involved generation of a large amount of 2nd phase deep in the sheet interior, and the resulting steel sheet did not have good stretch flanging formability. Further, due to the large amount of 2nd phase present it was also poor in terms of r-value.

In Example 1E (Table 4(1)), which is an example according to this invention, the recrystallization annealing process also served as carburization. This example provided generally satisfactory characteristics, although its r-value was somewhat lower as compared to when recrystallization and carburization were conducted separately.

In Comparative Example 1F (Table 4 (1)), no carburization was conducted. With this example, such characteristics as low yield ratio and satisfactory TS-El balance could not be obtained with the solid-solution reinforcement of the ferrite single phase alone.

Example 2 (Table 4(1)) is a comparative example which consisted of a composite-texture material in which the C-content was in excess of the initial upper limit in relation to Ti and which had undergone no carburization. In this example, the 2nd-phase distribution was uniform, so that the product had rather poor stretch flanging formability. Further, due to the large C-content in the initial composition, the r-value was rather low, with the yield elongation not completely eliminated.

In Example 3 according to the present invention, the 2nd phase consisted of a low-temperature-transformed ferrite. This example was satisfactory as to all characteristics (see Table 4 (1)). In particular, it had an excellent r-value.

Symbol 4A of Table 4(1) indicates an example according to the present invention in which the 2nd phase consisted of bainite ($Mn+3\ Mo+2\ Cr+Ni+10\ B<1.5$). This example was satisfactory in all characteristics.

Symbol 4B of Table 4(1) indicates an example according to the present invention in which the region near the sheet thickness center consisted of ferrite single phase. This example was satisfactory in all characteristics. In particular, it excelled in stretch flanging formability.

Symbol 5A of Table 4(1) indicates an example according to the present invention in which the 2nd phase consisted of bainite ($Mn+3\ Mo+2\ Cr+Ni+10\ B<1.5$). This example was satisfactory in all characteristics.

Symbol 5B of Table 4(1) indicates an example according to the present invention in which the 2nd phase consisted of bainite ($Mn+3\ Mo+2\ Cr+Ni+10\ B<1.5$, cooling rate: 15° C./sec). This example had generally satisfactory characteristics although it was somewhat lesser in terms of TS-E balance as compared to the other examples according to the present invention.

Example 6 of Table 4(1) is an example according to the present invention in which the 2nd phase contained residual $\gamma$ phase. This example was satisfactory in all characteristics. In particular, it excelled in TS-El balance.

Example 7 of Table 4(2) is a comparative example in which carburization was performed using a steel composition having a C-content in excess of 0.009% as the initial material. With this example, the initial C-content was too large to allow the optimum 2nd-phase distribution to be obtained, resulting in a 2nd-phase distribution which was substantially uniform. Thus, although the steel had the ability to restrain yield elongation, it had rather poor stretch flanging formability and a rather poor r-value.

Symbol 8 of Table 4(2) indicates an example according to the present invention in which the 2nd phase consisted of a mixture of bainite and pearlite. This example was satisfactory in all characteristics. In particular, it excelled in stretch flanging formability.

Symbol 9 of Table 4(2) indicates an example according to the present invention applied to a galvannealed steel sheet. In accordance with the heat-treatment cycle shown in FIG. 7(*a*), carburization and low-temperature retention processes were conducted after recrystallization annealing. It is desirable, from the viewpoint of material and cost, to conduct hot-dip zinc-coating and/or alloying within a predetermined low retention-temperature range.

Symbol 10 of Table 4(2) indicates an example according to the present invention applied to a cold-rolled steel sheet, in which, in accordance with the heat-treatment cycle shown in FIG. 7 (*b*), carburization was conducted after recrystallization annealing and, after rapid cooling to room temperature, low-temperature retention was effected by re-heating. This was a satisfactory product.

Symbol 11 of Table 4(2) indicates an example according to the present invention applied to a cold-rolled steel sheet, in which, in accordance with the heat-treatment cycle shown in FIG. 7 (*c*), carburization was conducted after recrystallization annealing, with a low-temperature retention of slow-cooling type conducted after rapid cooling to 500° C. Thus, the low-temperature retention does not have to be conducted by uniform heating. Further, the retention may be effected at two different temperatures.

Symbol 12 of Table 4(2) indicates an example according to the present invention applied to a steel to be hot-dip zinc-coated. In accordance with the heat-treatment cycle shown in FIG. 7 (*d*), carburization was conducted at the same temperature after recrystallization annealing and then hot-dip zinc-coating was performed which also served for low-temperature retention.

Symbol 13 of Table 4(2) indicates an example according to the present invention applied to a steel to be galvannealed. In accordance with the heat-treatment cycle shown in FIG. 7(*e*), galvannealing was performed after recrystallization annealing, carburization and low-temperature retention.

As described above, this invention makes it is possible to create a high tensile steel sheet for working which has significantly improved stretch flanging formability as compared to conventional steel sheets, without impairing the excellent characteristics of the composite-texture steel sheet.

What is claimed is:

1. A high tensile steel sheet having excellent stretch flanging formability which is of a composite texture composed of a ferrite phase and a second phase selected from the group consisting of at least one of martensite, bainite, pearlite, retained austenite and low-temperature transformed ferrite, wherein said second phase has a volume fraction not less than about 1.3 times higher at (A) an outer position extending from a location adjacent the surface of the steel sheet to a depth of about ¼ of the sheet thickness, than in (B) an inner region extending from a depth corresponding to ¼ of the sheet thickness to the center of the sheet.

2. A high tensile steel sheet according to claim 1, wherein said steel sheet contains about 0.004 to 0.2 wt % of C, not more than about 2.0 wt % of Si, not more than about 3.5 wt % of Mn, not more than about 0.25 wt % of P, not more than about 0.10 wt % of S, and not more than about 0.0050 wt % of N, and, further, at least one of about 0.002 to 0.2 wt % of Ti and about 0.002 to 0.2 wt % of Nb, the remaining portion of said steel sheet consisting of iron and incidental impurities.

3. A high tensile steel sheet according to claim 2, further containing at least one of about 0.03 to 5.0 wt % of Mo, about 0.1 to 5.0 wt % of Cr, about 0.1 to 5.0 wt % of Ni, about 0.1 to 5.0 wt % of Cu, and about 0.0002 to 0.10 wt % of B.

4. A high tensile steel sheet excellent in stretch flanging formability according to any one of claims 1 through 3, further comprising a plated surface layer on the sheet.

* * * * *

UNITED STATES PATENT AND TRADEMARK OFFICE

CERTIFICATE OF CORRECTION

PATENT NO. : 5,332,453

DATED : July 26, 1994

INVENTOR(S) : Susumu Okada, Kouichi Kirata, Susumu Sato, Masahik Morita and Tsuguhiko Nakagawa It is certified that error appears in the above-indentified patent and that said Letters Patent is hereby corrected as shown below:

In Column 3, line 54, please change "obtainer" to --obtained--.

In Column 5, line 8, please change "Ac" to --$Ac_1$--; and line 51, please change "!.50" to --150--.

In Column 7, line 32, please change "Ti*:-" to --Ti*--.

In Column 8, line 13, please change "Ac" to --$Ac_1$--;
line 37, please change "Ac" to --$Ac_1$--;
line 47, please change "Ac" to --$Ac_1$--; and
line 68, please change "Ac" to --$Ac_1$--.

In Column 9, line 2, please change "Ac" to --$Ac_1$--.

In Column 15, line 48, please change "TS-E" to --TS-Eℓ--; and line 53, please change "TS-El" to --TS-Eℓ--.

Signed and Sealed this

Twenty-seventh Day of September, 1994

*Attest:*

*Attesting Officer*

Bruce Lehman

BRUCE LEHMAN

*Commissioner of Patents and Trademarks*